US009212510B2

(12) United States Patent
Eungard et al.

(10) Patent No.: US 9,212,510 B2
(45) Date of Patent: Dec. 15, 2015

(54) SEALING SYSTEMS AND ASSOCIATED DEVICES FOR SEALING LOADING DOCK DOORS AND THE LIKE

(71) Applicant: 4Front Engineered Solutions, Inc., Carrollton, TX (US)

(72) Inventors: William C. Eungard, Waterford, WI (US); Joshua James Brown, Waukesha, WI (US); Ryan John Talbot, Oconomowoc, WI (US)

(73) Assignee: 4Front Engineered Solutions, Inc., Carrollton, TX (US)

( * ) Notice: Subject to any disclaimer, the term of this patent is extended or adjusted under 35 U.S.C. 154(b) by 0 days.

(21) Appl. No.: 13/924,868

(22) Filed: Jun. 24, 2013

(65) Prior Publication Data

US 2014/0373457 A1 Dec. 25, 2014

(51) Int. Cl.
*E05D 15/24* (2006.01)
*E06B 7/16* (2006.01)

(52) U.S. Cl.
CPC . *E05D 15/24* (2013.01); *E06B 7/16* (2013.01); *E05Y 2800/12* (2013.01)

(58) Field of Classification Search
CPC ..... E06B 7/16; E06B 7/22; E06B 7/23; E06B 7/2305; E06B 7/2307; E06B 7/2309; E06B 7/231; E06B 7/2312
USPC ..... 49/197, 199, 479.1, 482.1, 484.1, 49/493.1, 496.1, 498.1, 500.1
See application file for complete search history.

(56) References Cited

U.S. PATENT DOCUMENTS

| | | | | | |
|---|---|---|---|---|---|
| 1,610,677 | A | * | 12/1926 | Gustav | 49/406 |
| 1,666,043 | A | * | 4/1928 | Campbell | 49/424 |
| 1,695,073 | A | * | 12/1928 | Wirfs, Jr. | 49/475.1 |
| 1,787,451 | A | | 1/1931 | Mohun et al. | |
| 3,029,480 | A | * | 4/1962 | Signorelli et al. | 277/649 |
| 3,693,693 | A | | 9/1972 | Court | |
| D245,266 | S | | 8/1977 | Gorse | |
| 4,119,133 | A | | 10/1978 | Wolf | |
| 4,437,266 | A | * | 3/1984 | Keller | 49/493.1 |
| 4,452,293 | A | | 6/1984 | Gorse | |
| 4,467,853 | A | | 8/1984 | Downey, Jr. | |
| 4,643,239 | A | * | 2/1987 | Wentzel | 160/201 |
| 4,676,293 | A | | 6/1987 | Hanssen | |
| 4,776,379 | A | | 10/1988 | Kraetler | |
| 4,880,045 | A | | 11/1989 | Stahler | |
| 5,025,847 | A | | 6/1991 | Mueller | |
| 5,139,075 | A | | 8/1992 | Desrochers | |
| 5,141,043 | A | | 8/1992 | Kraeutler | |
| 5,141,044 | A | | 8/1992 | Hying et al. | |
| 5,163,494 | A | | 11/1992 | MacNeil et al. | |
| 5,165,746 | A | | 11/1992 | Teigen | |

(Continued)

*Primary Examiner* — Katherine Mitchell
*Assistant Examiner* — Catherine A Kelly
(74) *Attorney, Agent, or Firm* — Perkins Coie LLP

(57) ABSTRACT

Systems, devices and components for the sealing of doors, including overhead doors at loading docks, and associated methods of manufacture and use are disclosed herein. A door sealing system configured in accordance with one embodiment of the disclosure includes a seal extension having a body with a first edge and a second edge. The seal extension can include a bulb seal portion extending from the first edge to form a first seal between the door and a first surface extending adjacent to a side edge of the door. The seal extension can also include a blade seal portion extending from the second edge to form a second seal between the door and a second surface extending adjacent to an upper edge of the door.

10 Claims, 9 Drawing Sheets

(56) References Cited

U.S. PATENT DOCUMENTS

| | | | | |
|---|---|---|---|---|
| 5,219,015 | A | 6/1993 | Kraeutler | |
| 5,222,541 | A | 6/1993 | Hornberger | |
| 5,246,053 | A | 9/1993 | Kraeutler | |
| 5,544,690 | A | 8/1996 | Magro et al. | |
| 5,718,276 | A | 2/1998 | Rekret | |
| 5,927,368 | A | 7/1999 | Rohrer et al. | |
| 6,098,696 | A * | 8/2000 | Styra | 160/201 |
| 6,119,307 | A | 9/2000 | Weishar et al. | |
| 6,190,751 | B1 | 2/2001 | Sylvestor | |
| 6,279,284 | B1 | 8/2001 | Moras | |
| 6,374,567 | B1 | 4/2002 | Mullet | |
| 8,490,669 | B2 | 7/2013 | Fletcher et al. | |
| 2004/0040214 | A1 * | 3/2004 | Bitner, II | 49/475.1 |
| 2010/0319143 | A1 | 12/2010 | Wessell | |

* cited by examiner

SEALING SYSTEMS AND ASSOCIATED DEVICES FOR SEALING LOADING DOCK DOORS AND THE LIKE

TECHNICAL FIELD

The following disclosure relates generally to sealing systems, and more specifically to sealing systems for overhead doors.

BACKGROUND

Overhead doors are commonly used on loading docks and in various warehouse and factory settings. These doors often include one or more seals positioned along an edge to help reduce the passage of air and/or moisture between the door edge and the facility. For example, a blade seal is often provided along a top edge of the door to seal a horizontal gap between the upper portion of the door and the adjacent building wall. The blade seal is usually positioned to extend past the top corners of the door and is held in place by a metal seal retainer that extends along the top edge of the door. The seal retainer can reduce the tendency of the blade seal to bend or deflect away from the building.

Conventional overhead doors typically include one or more panels that are coupled to track assemblies having vertical tracks that guide the door as it moves upwardly into an overhead or open position. To reduce the chance of impact and damage to the seal retainer or the guide tracks, the ends of the seal retainer are set back from the top corners of the door. As a result, the end portions of the blade seal that extend outwardly past the top corners of the door can deflect away from the building and/or away from the track assemblies, providing a gap for the passage of air and/or moisture. Accordingly, although conventional blade seals can provide sufficient sealing along a portion of the top edge of a door, such seals typically provide poor sealing at the top corners of the door.

DETAILED DESCRIPTION

The following disclosure describes various embodiments of door sealing systems, devices and components for use with doors (e.g., overhead doors), and associated methods of manufacture and use. In one embodiment, a door sealing system includes a pair of seal extensions that can be mounted to a top edge of a door in conjunction with a blade seal that extends along the top edge. The seal extensions can include adjustable mounting features to assist in precise positioning of the seal extensions. The seal extensions can provide an enhanced seal between the door and an adjacent building wall, particularly in the vicinity of the corners of the door opening.

Certain details are set forth in the following description and FIGS. 1A-9 to provide a thorough understanding of various embodiments of the present technology. Other details describing well-known structures and systems often associated with seals, sealing systems, and overhead doors, however, are not set forth below to avoid unnecessarily obscuring the description of the various embodiments of the present technology.

Many of the details and features shown in the Figures are merely illustrative of particular embodiments of the present technology. Accordingly, other embodiments can have other details and features without departing from the spirit and scope of the present disclosure. In addition, those of ordinary skill in the art will understand that further embodiments can be practiced without several of the details described below. Furthermore, various embodiments of the present technology can include structures other than those illustrated in the Figures and are expressly not limited to the structures shown in the Figures. Moreover, the particular features, structures, or characteristics described with reference to any of the embodiments herein may be combined in any suitable manner in one or more other embodiments. Finally, the various elements and features illustrated in the Figures may not be drawn to scale.

In the Figures, identical reference numbers identify identical, or at least generally similar, elements. To facilitate the discussion of any particular element, the most significant digit or digits of any reference number refer to the Figure in which that element is first introduced. Element 104, for example, is first introduced and discussed with reference to FIG. 1A.

Figure 1A:
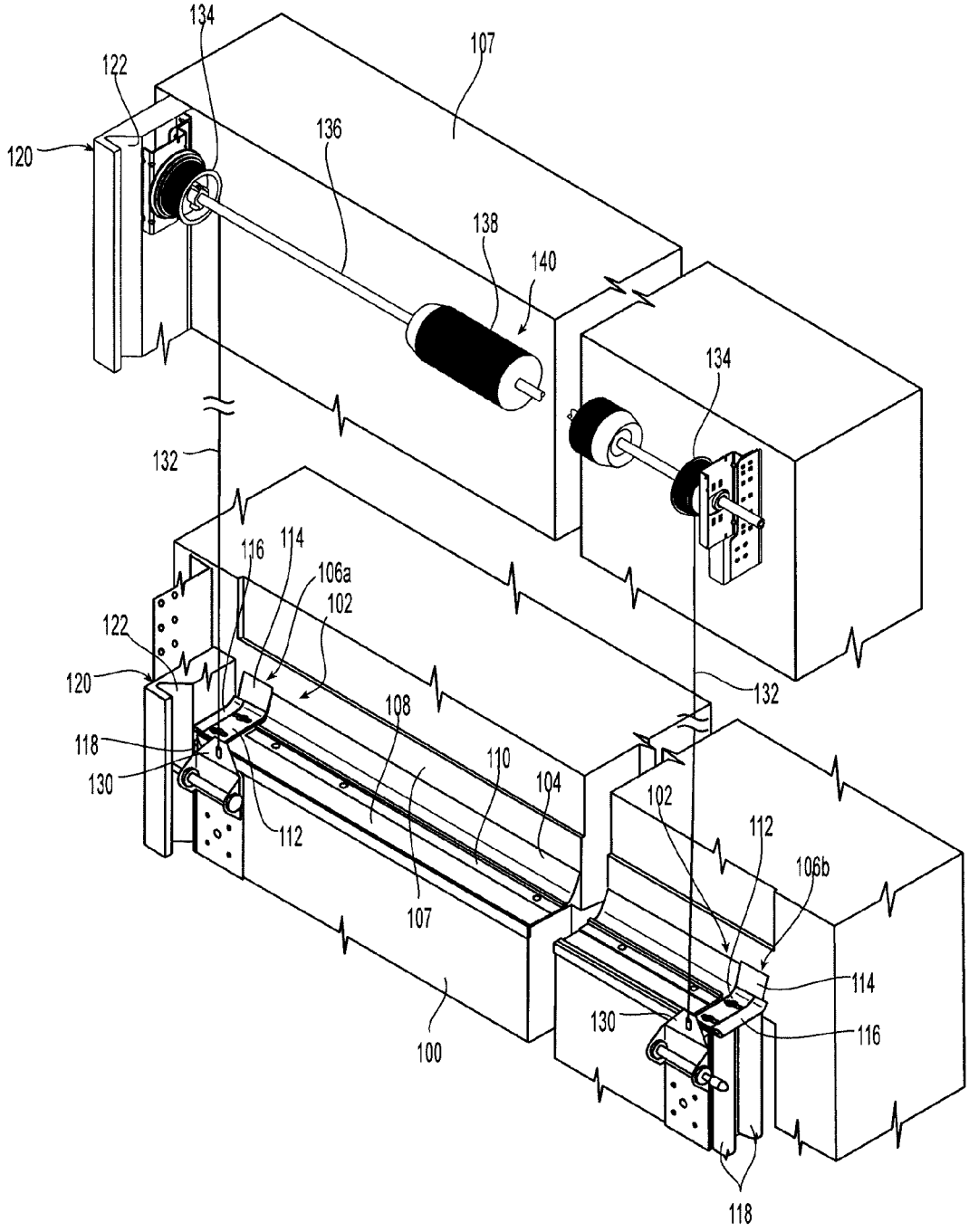
FIG. 1A is an isometric top view of a portion of an overhead door having a door sealing system configured in accordance with an embodiment of the present technology.

FIG. 1A is an isometric top view of an upper portion of an overhead door 100 having a door sealing system 102 configured in accordance with an embodiment of the present technology. In the illustrated embodiment, the door sealing system 102 includes a blade seal 104 and a pair of seal extensions 106 (identified individually as a first seal extension 106*a* and a second seal extension 106*b*). The blade seal 104 extends along a top edge 108 of the door 100 adjacent to a wall 107 (e.g., a header). The blade seal 104 can be secured to the door 100 via a seal retainer 110 (e.g., a metal or aluminum retainer). Each individual seal extension 106 can include a body 112, a first sealing portion or blade seal portion 114, and a second sealing portion or bulb seal portion 116. The door sealing system 102 can further include one or more side seals 118 (e.g., bulb seals having internal cavities) attached to the side edges of the door 100.

The door 100 can be movably coupled to a pair of track assemblies 120 (for clarity, only one track assembly 120 is shown in FIG. 1A) having associated guide tracks 122. Rollers or plungers can extend outwardly from the sides of the door 100 to movably engage the adjacent guide tracks 122 and facilitate movement of the door between a closed or down position (as shown) and a raised or open position. For example, the door 100 can include attached brackets 130 that operably couple the door 100 to a lifting system 140 via cables 132. A first end portion of each of the cables 132 can be coupled to a corresponding bracket 130, and an opposite end portion of each cable 132 can be attached to a corresponding drum 134 of the lifting system 140. The lifting system 140 can be a conventional counterbalance assembly having one or more biasing members 138 (e.g., torsion springs) operably coupled to a shaft 136 to rotationally bias the drums 134 in a direction that applies tension to the cables 132 to assist in raising of the door 100. The lifting system 140, door 100, track assemblies 120, brackets 130, and/or other systems, devices and/or components described in the present disclosure, can be at least generally similar in structure and function to systems, devices and/or components described in U.S. patent application Ser. No. 13/079,437, entitled DOOR LEVELING APPARATUSES AND ASSOCIATED METHODS OF MANUFACTURE AND USE, filed Apr. 4, 2011, the entirety of which is incorporated by reference herein.

Figure 1B:
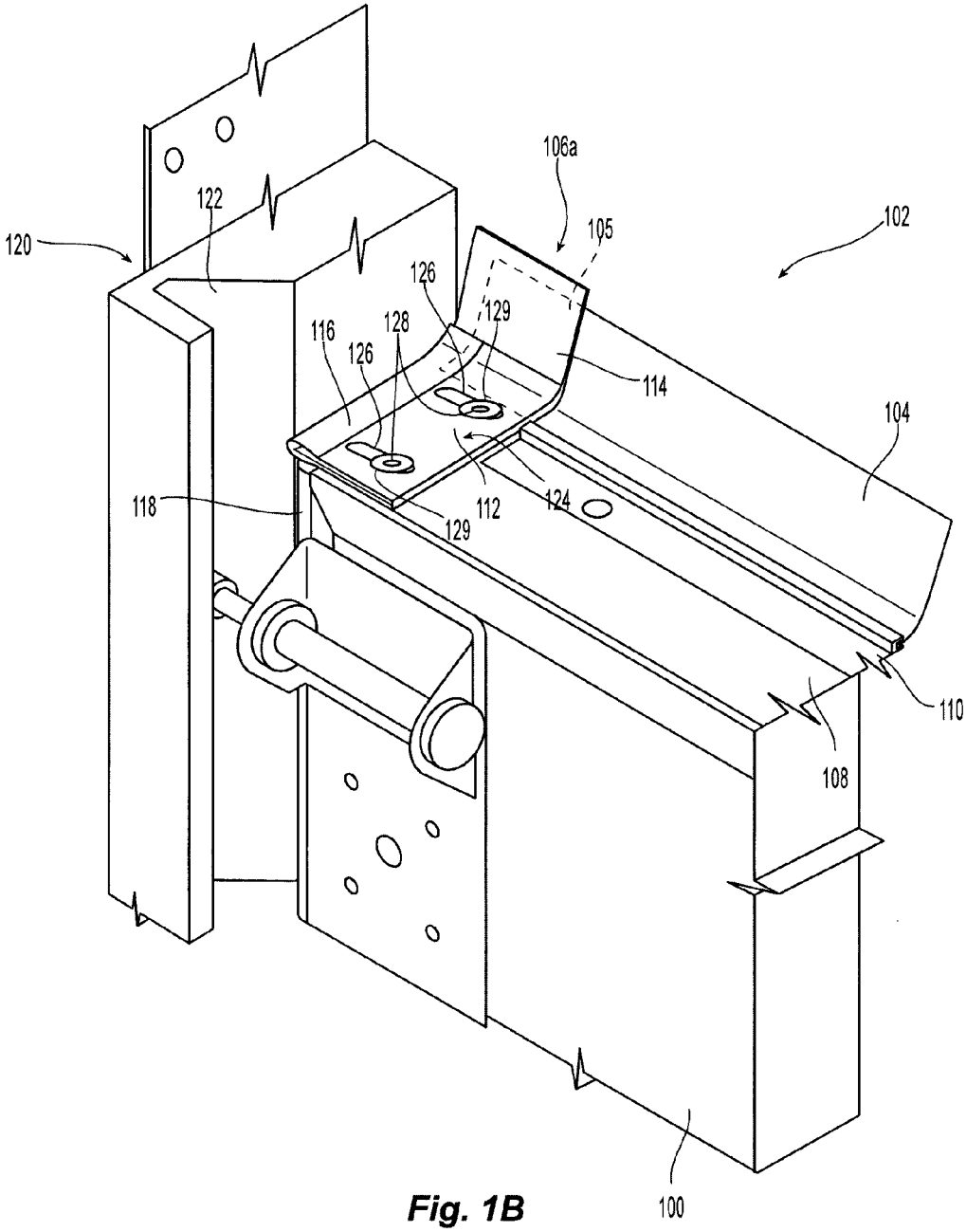
FIG. 1B is an enlarged isometric top view of a portion of the door sealing system of FIG. 1A.

FIG. 1B is an enlarged isometric top view of a portion of the door sealing system 102 of FIG. 1A. In the illustrated embodiment, the seal extension 106*a* includes an adjustable mounting feature 124 having a pair of elongated openings or fastener slots 126 in the body 112. Fasteners 128 (e.g., screws) can extend through corresponding washers 129 and through the individual slots 126 to mount the seal extension 106*a* to the top edge 108 of the door 100 adjacent to the end of the seal retainer 110. The seal extension 106*a* can be mounted such that the blade seal portion 114 at least partially overlaps an end portion 105 of the blade seal 104 (as shown in the illustrated embodiment). Additionally, the adjustable mounting feature 124 enables the position of the seal extension 106*a* to be adjusted relative to the door 100, and enables the bulb seal portion 116 to maintain a close fit against the adjacent surface of the track assembly 120, as further described below.

Figure 2:
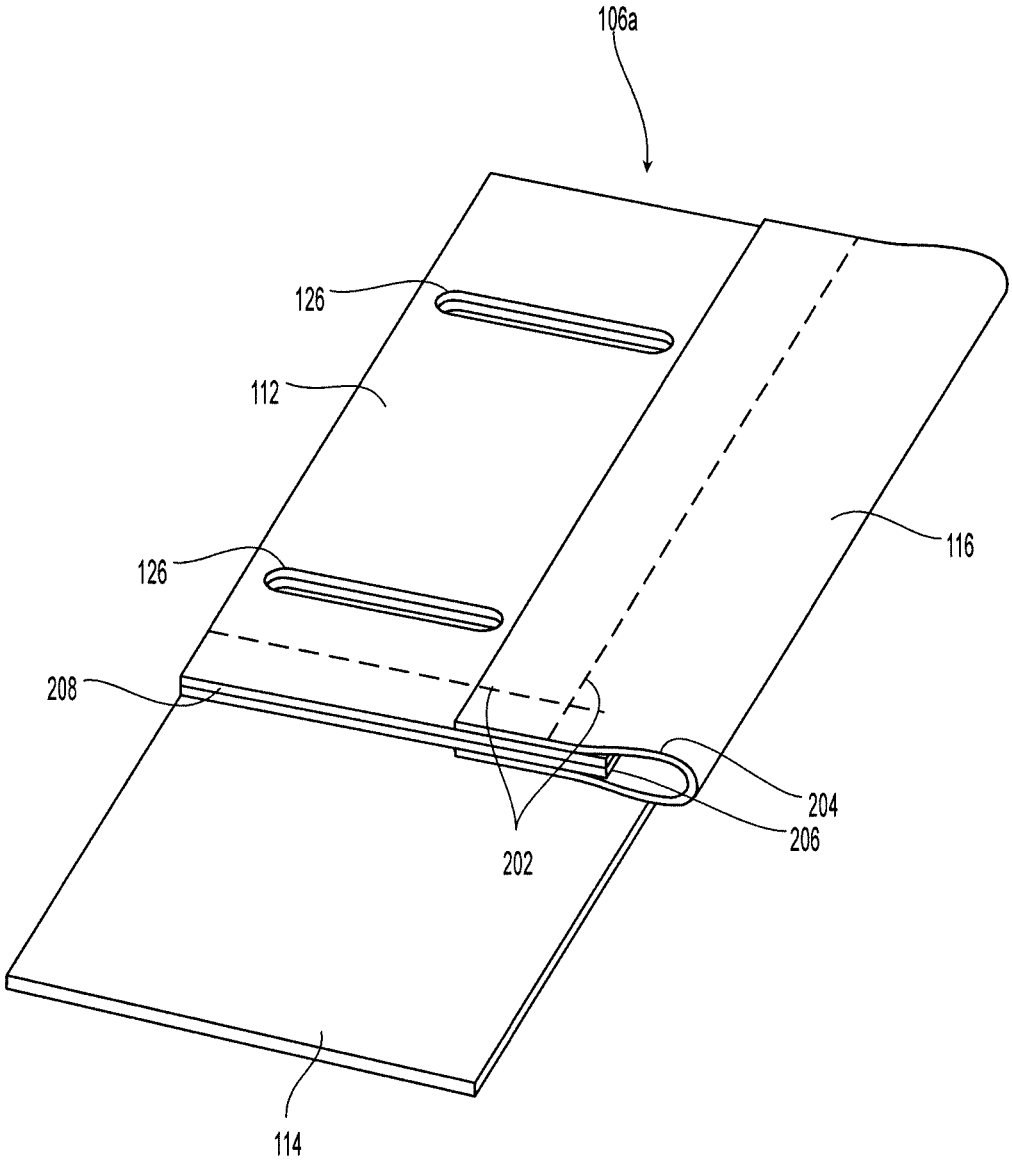
FIG. 2 is an isometric top view of a seal extension configured in accordance with an embodiment of the present technology.

FIG. 2 is an isometric top view of the seal extension 106*a* of FIGS. 1A and 1B. The seal extensions 106 can be constructed from various suitable materials known in the art and in a variety of manners. For example, the body 112, the blade seal portion 114, and/or the bulb seal portion 116 can be constructed from polymers (e.g., rubber, synthetic rubber, vinyl, plastic, etc.) and/or other resilient materials. In a particular embodiment, the body 112 can be semi-rigid and constructed from a heavy vinyl fabric (e.g., 100 ounce, two-ply vinyl fabric from Derco). In other embodiments, the body 112 can be constructed from other materials, including other semi-rigid, rigid, or flexible materials. The body 112 can be, for example, cut or stamped from a larger piece of material and the slots 126 can be cut or stamped from the body 112.

The bulb seal portion 116 can be constructed from a variety of materials, including vinyl. For example, in the illustrated embodiment of FIG. 2, the bulb seal portion 116 is composed of a relatively thin vinyl, as compared to that of the body 112. The bulb seal portion 116 can be formed by folding a piece of vinyl over a first or outboard edge 206 of the body 112 and attaching the piece of vinyl to the body 112 (e.g., via stitches 202) to form a loop or bulb 204 that extends from the edge 206. The bulb 204 is compressible and can form a conformable seal against the adjacent surface of the corresponding track assembly 120.

In several embodiments, the blade seal portion 114 and the blade seal 104 (FIGS. 1A and 1B) can be formed or made from the same type of material. In a particular embodiment the blade seal 104 and the blade seal portion 114 are composed of a synthetic rubber (e.g., an ethylene propylene diene monomer (EPDM) rubber) that can be molded, formed, and/or cut into a suitable shape. The blade seal portion 114 can be positioned to extend from a second or front edge 208 of the body 112 and can be attached to the body 112 via stitching (e.g., nylon thread stitches 202). In the illustrated embodiment, the body 112 is positioned over the blade seal portion 114 to provide support to the blade seal portion 114 and reduce flexing or bending, as further described below.

Figure 3:
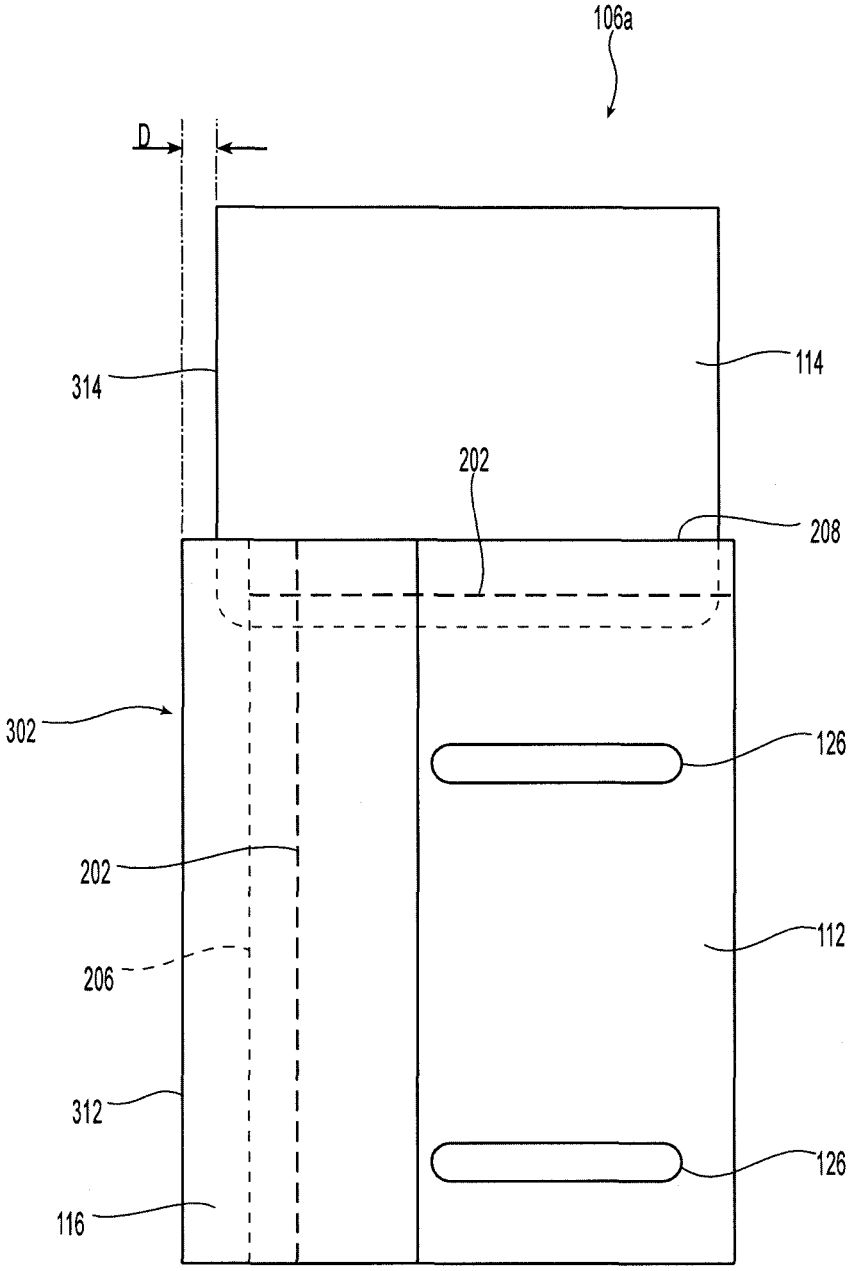
FIG. 3 is a top view of the seal extension of FIG. 2.

FIG. 3 is a top view of the seal extension 106*a* of FIG. 2. In the illustrated embodiment, a first outer edge 312 of the bulb seal portion 116 is offset from a second outer edge 314 of the blade seal portion 114 by a distance D along a common side 302 of the seal extension 106*a*. The common side 302 of the seal extension 106*a* can be positioned adjacent to the track assembly 120 (FIG. 1) to form a seal against the adjacent surface of the track assembly 120, as further described below. Similarly, the seal extension 106*b* can form a seal against the opposite track assembly 120 positioned on the opposite side of the door 100.

In conventional door sealing systems, a blade seal often extends across the top of the door and past the sides of the door towards an adjacent wall or track assembly in an attempt to seal the areas near the upper corners of the door. The blade seal is often cut or otherwise sized in the field (e.g., at a facility in which it is installed) to provide a close fit against an adjacent track assembly. However, gaps are often present between the ends of the blade seal and the adjacent tracks because the cut or sizing is not precise enough. Additionally, conventional door sealing systems often include a seal retainer that is usually shorter than the width of the door and does not extend to the side edges of the door to prevent interference and possible damage that may occur due to impacts between the seal retainer and the track assemblies. Accordingly, the portions of the blade seal that extend past the top of the sides of the door are not retained in position, and when the door is closed, the end portions of the blade seal can deflect upwards to open a gap that allows for the passage of air and/or moisture into or out of the facility. Embodiments in accordance with the present technology can reduce these gaps, support the portions of the blade seal that extend past the door, and can provide a more robust and secure seal system.

The door sealing system 102 can provide for an enhanced seal between the door 100 and the wall 107, and between the door 100 and the track assembly 120 (FIG. 1A). For example, referring to FIGS. 1A-3, the blade seal 104 can be cut or otherwise sized to extend across the top edge 108 of the door 100 and just past the side edges of the door 100. The seal retainer 110 can be sized to extend along the top edge 108, and not past the side edges of the door 100. The seal retainer 110 can reduce deflection of the blade seal 104 and help to maintain contact between the blade seal 104 and the adjacent wall 107. Accordingly, the blade seal 104 and the associated seal retainer 110 can provide a seal between the door 100 and the adjacent wall 107 along most of the width of the door 100.

The adjustable seal extensions 106 can be positioned along the top edge 108 in the upper corners of the door 100 to provide a seal between the upper corners of the door 100 and one or more first surfaces extending adjacent to the side edges of the door (e.g., the adjacent surfaces of the associated track assemblies 120), and between the upper corners of the door 100 and one or more second surfaces extending adjacent to the top edge 108 (e.g., a surface of the wall 107). For example, the seal extensions 106 can be attached to the door 100 prior to installation of the door 100, and can subsequently be adjusted after installation of the door 100 to provide a more precise seal. More specifically, the seal extensions 106 can be positioned along the top edge 108 adjacent to or near the seal retainer 110, and temporarily secured to the door 100 with the fasteners 128 at the outer ends of the slots 126 (i.e., with the seal extensions 106 positioned at a furthest most inward position). After installation of the door 100 at a facility, the fasteners 128 can be loosened and the seal extensions 106 can be slid outwardly until the bulb seal portions 116 are at least partially compressed against the track assemblies 120. The fasteners 128 can then be retightened to secure the seal extensions 106 in an operational position. When the seal extensions 106 are in the outward, operational positions (as shown in FIGS. 1A and 1B), the bulb seal portions 116 are partially compressed to maintain a seal against the adjacent surfaces of the associated track assemblies 120. Additionally, the body 112 and/or the bulb seal portions 116 can provide a seal against the side seals 118, reducing any air flow through or between the side seals 118. Furthermore, in the operational position, the blade seal portions 114 can at least partially overlap the blade seal 104, thereby supporting the blade seal 104 and providing a continuous seal along the wall 107, as well as providing a seal along a portion of the adjacent surfaces of the associated track assemblies 120.

In operation, the blade seal 104 and the seal extensions 106 can maintain an enhanced seal when the door 100 is in a closed position, even after significant numbers of cycles of opening and closing of the door 100 and/or impacts or misalignments of the door 100. For example, the conformable loop or bulb 204 of the bulb seal portions 116 can maintain a seal against the track assembly 120, even if the door 100 undergoes a shift in its closed position. Specifically, if the closed position of the door 100 shifts to one or the other side as a result of an impact, wear, or any other reason, the bulb seal portion 116 on one side will compress and maintain a seal against the adjacent surface of the associated track assembly 120, while the bulb seal portion 116 on the opposite side of the door 100 will expand and maintain a seal against the adjacent surface of its associated track assembly 120. Furthermore, if the door undergoes a significant shift that causes the body 112 to impact the track assembly 120, the body 112 can flex or deflect and subsequently return to position to maintain a seal.

Figure 4A:
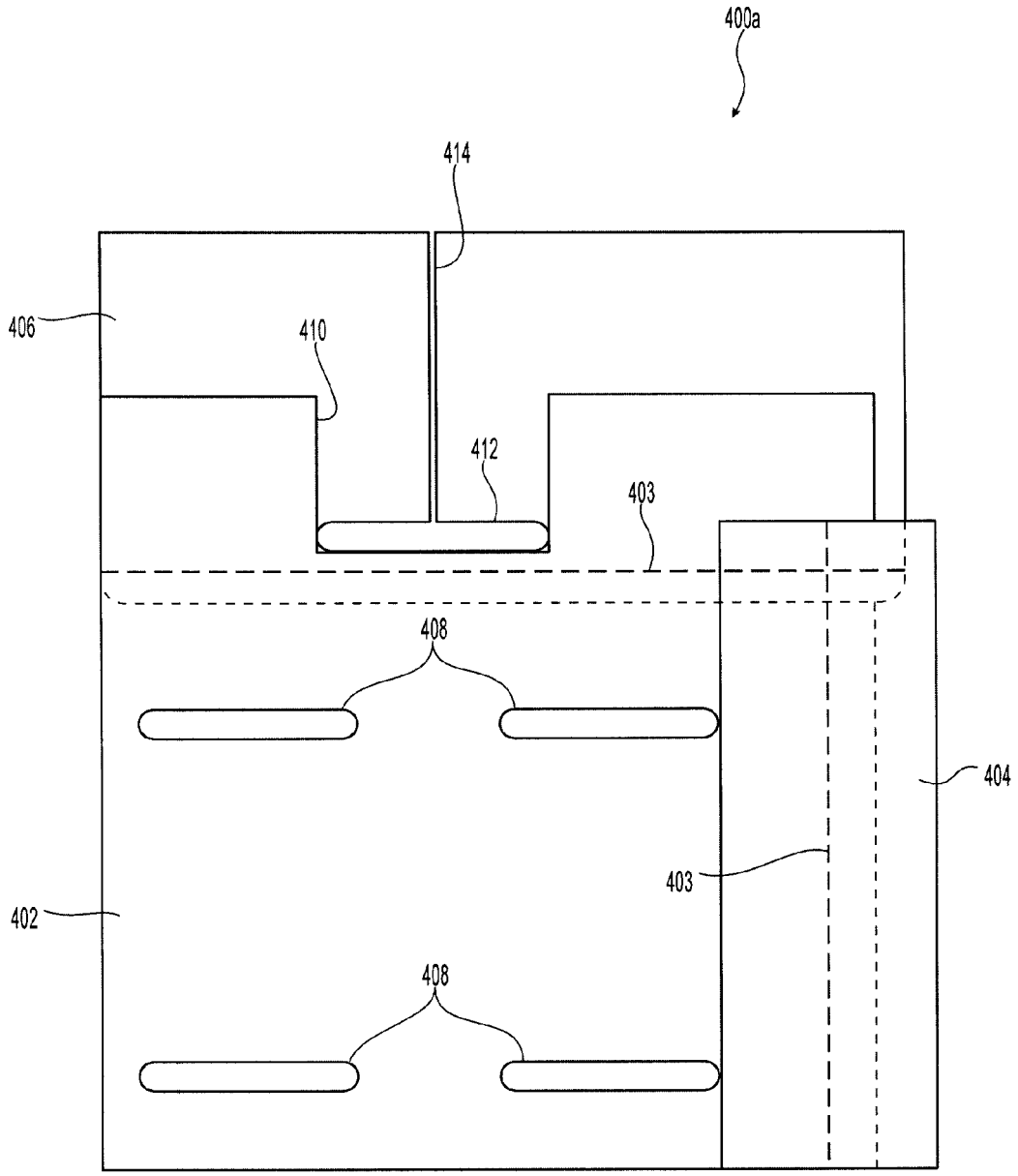
FIG. 4A is a top view of a seal extension configured in accordance with another embodiment of the present technology.

FIG. 4A is a top view of a first seal extension 400*a* configured in accordance with another embodiment of the present technology. The first seal extension 400*a* can include features and components that are at least generally similar to the seal extensions 106 of FIGS. 1A-3. For example, the first seal extension 400*a* includes a bulb seal portion 404 and a blade seal portion 406 attached via stitches 403 to a semi-rigid body 402. In the illustrated embodiment, the body 402 includes a plurality of elongated openings or slots 408 and a cutout 410. Additionally, the blade seal portion 406 includes a cable slot 412 and a cable passage 414. The cable passage 414 can accommodate operating cables that extend downwardly in front of the door and connect to a lower portion of the door for raising and lowering the door, as described below. The cable slot 412 can be formed by removing or cutting out a section of the blade seal portion 406, and the cable passage 414 can be made by cutting the blade seal portion 406 along a line running from the cable slot 412 to the edge of the blade seal portion 406.

Figure 4B:
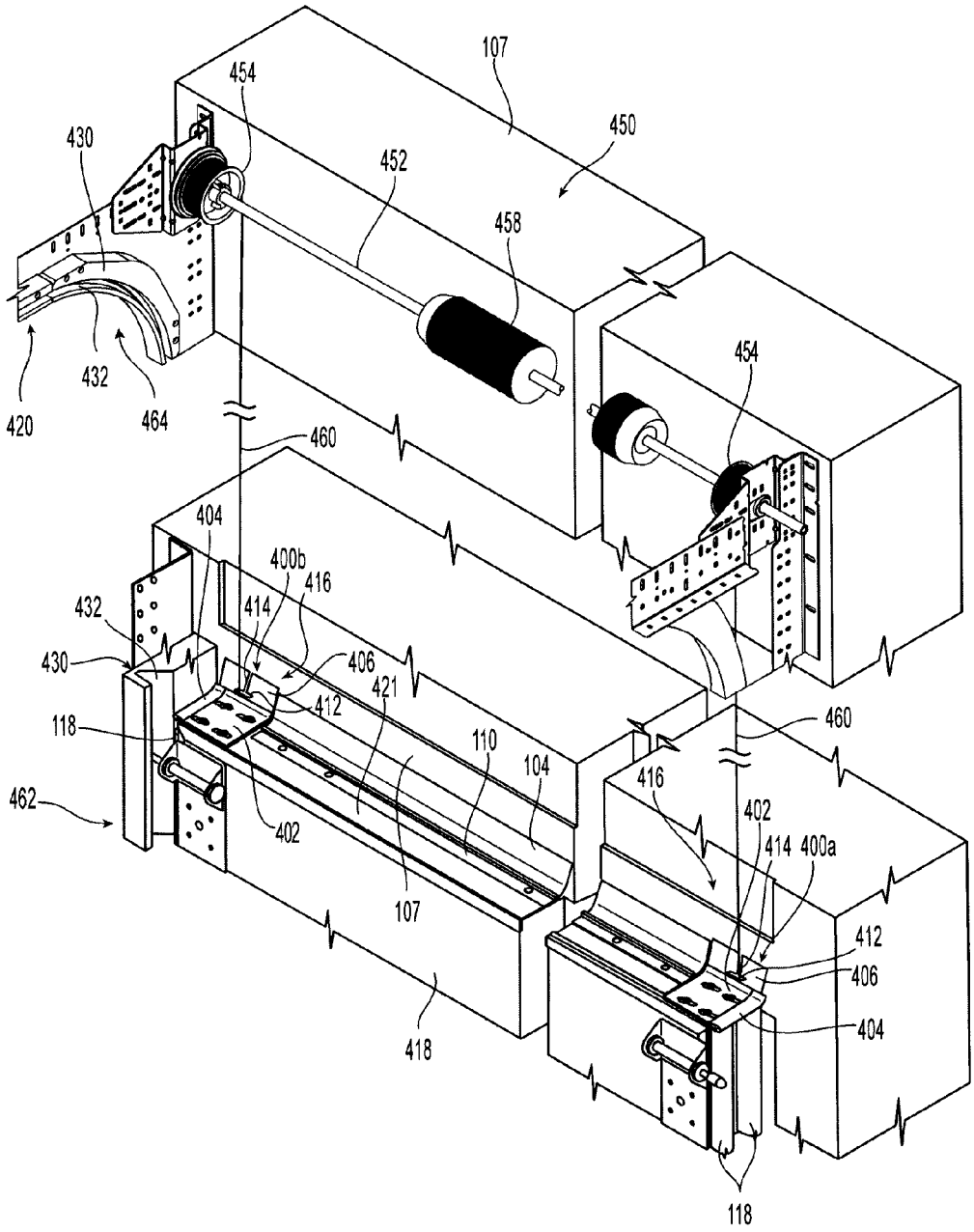
FIG. 4B is an isometric top view of a portion of an overhead high-lift door having a door sealing system configured in accordance with an embodiment of the present technology.

FIG. 4B is an isometric top view of a portion of an overhead high-lift door 418 having a door sealing system 416 configured in accordance with an embodiment of the present technology. The door sealing system 416 can include several components that are at least generally similar to those of the door sealing system 102 described above with reference to FIGS. 1A-3. For example, the side seals 118 can be attached to the side edges of the door 418 and the seal retainer 110 can couple the blade seal 104 to a top edge 421 of the door 418. The door 418 can be operably coupled to track assemblies 430 (for clarity, only one track assembly 430 is shown in FIG. 4B) having guide tracks 432. The track assemblies 430 can have a vertical portion 462, a transition portion 464, and a horizontal portion 420. A lifting system 450 having shaft 452, drums 454, and a biasing member 458 can be operably coupled to the door via cables 460. For example, the cables 460 can extend vertically downward from the drums 454 in front of the door 418 to connect to a lower portion of the door (not visible).

The door sealing system 416 further includes the first seal extension 400*a* positioned on the right side of the top edge 421 of the door 418 and a second seal extension 400*b* positioned on the left side of the top edge 421 of the door 418. The first seal extension 400*a* and the second seal extension 400*b* (collectively the seal extensions 400) can function in a manner at least generally similar to the seal extensions 106 described above. For example, the seal extensions 400 can at least partially overlap the blade seal 104 to form a seal along the wall 107 and can form a seal against an adjacent track assembly 430 via the bulb seal portions 404. Additionally, the bodies 402 and/or the bulb seal portions 404 can provide a seal against the side seals 118.

In operation, the seal extensions 400 can maintain an effective seal while accommodating the cables 460. For example, as the cables 460 are wound onto the drums 454, the blade seal portion 406 can maintain a seal with the wall 107, while the cable slots 412 accommodate movement of the cables 460. As the door 418 is raised, the plungers of the door 418 move along the guide tracks 432 from the vertical portion 462 of the track assembly 430, through the transition portion 464, and to the horizontal portion 420. Accordingly, the door 418 and the attached seal extensions 400 move away from the wall 107 and the cables 460 when the door is raised to an open, horizontal storing position. In the illustrated embodiment, the cable passages 414 can provide for movement of the cables 460 into and out of the cable slots 412 as the upper portion of the door 418 moves toward or away from the cables 460. Accordingly, the seal extensions 400 can provide sealing capabilities for doors (e.g., overhead horizontally storing doors) that move toward and away from cables during closing and opening.

In several embodiments, the cable passage 414 can be cut in the field to ensure accurate positioning. For example, the position of the cable passage 414 relative to the cable slot 412 can vary depending on the particular door or cable. In some embodiments, a technician or installer can position the seal extension 400 on a door and move the door to determine the position at which the cable attempts to enter the cable slot 412. The installer can then cut the blade seal portion 406 to form the cable passage 414 in the correct position.

Although the seal extensions 106 and 400 described above include a plurality of components (e.g., the body 112, the blade seal portion 114 and the bulb seal portion 116), seal extensions in accordance with the present technology can include fewer or more components. In some embodiments, for example, seal extensions can be composed of a single contiguous component. In a particular embodiment, a seal extension can be a single component formed from an injection molded elastomeric material. In such an embodiment, the seal extension can have varying thicknesses and/or other design features to provide at least generally similar performance to the seal extensions 106 described above and illustrated in FIGS. 1A-4B. For example, a molded seal extension 106 or 400 can include a thicker section that is positioned against or adjacent to a door, and one or more thinner sections that are positioned adjacent to a track assembly and/or a wall.

The embodiments described above include seal extensions 106 and 400 positioned on doors to form a seal between a door and an associated track assembly positioned beside the door, and between the door and a wall positioned in front of and/or above a door. However, seal extensions in accordance with the present technology can also form a seal with other components or parts positioned adjacent a door, (e.g., a wall adjacent to the side of a door). For example, in several embodiments, seal extensions can be attached to doors that, when closed, are positioned within an opening in a wall and surrounded by the wall on three sides. Seal extensions can be attached to an upper edge of the door and form a seal between the door and the portions of the wall that are adjacent to the side of the door.

Figure 5B:
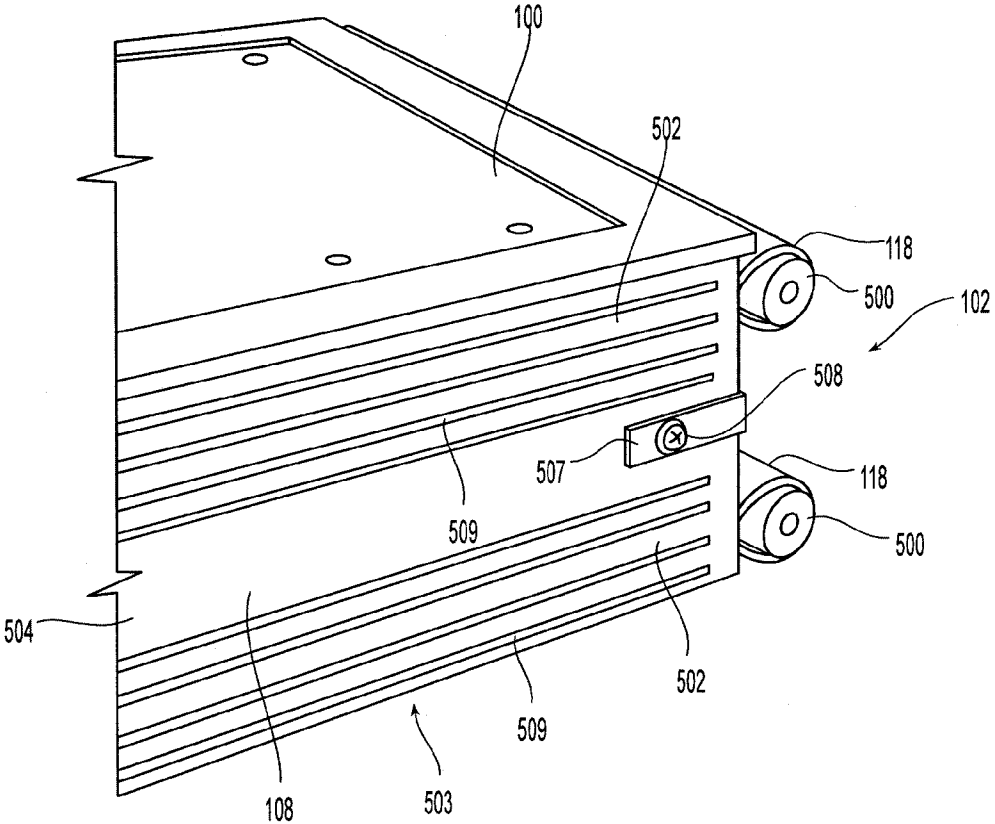
FIG. 5B is isometric top view of a door sealing system configured in accordance with an embodiment of the present technology.
Figure 5A:
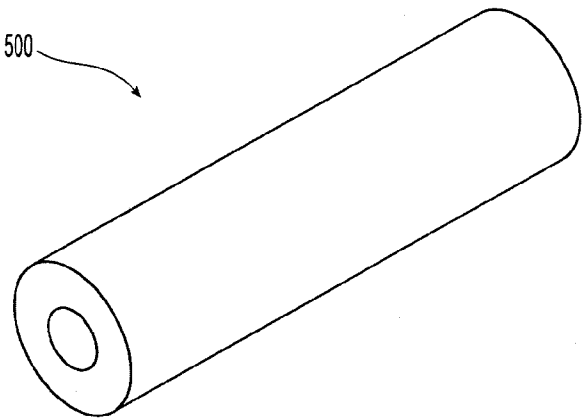
FIG. 5A is an isometric view of a bulb plug configured in accordance with an embodiment of the present technology.

FIG. 5A is an isometric view of a bulb plug 500 configured in accordance with an embodiment of the present technology. The bulb plug 500 can be constructed of foam and can have a generally cylindrical shape. For example, in the illustrated embodiment, the bulb plug 500 has an annular cylindrical shape. In several embodiments, the sealing systems 102 and 416 described above can include individual bulb plugs 500 inserted into internal cavities of each of the individual side seals 118 (FIG. 1A), as further described below.

FIG. 5B is isometric top view of the door 100 and the door sealing system 102 configured in accordance with an embodiment of the present technology. In the illustrated embodiment, the bulb plugs 500 are positioned near the top of the individual side seals 118, and extend partially above the top of the individual side seals 118. Accordingly, the bulb plugs 500 can abut the underside of associated seal extensions 106 or 400. The bulb plugs 500 can provide an enhanced seal by reducing any gaps between the side seals 118 and the seal extensions 106 or 400, and/or reducing any air flow through the side seals 118. Although the bulb plug 500 in the illustrated embodiment is shaped as an annular cylinder, bulb plugs in accordance with the present technology can be shaped in a variety of suitable forms, including solid cylinders, spheres, rectangular shapes, square shapes, etc.).

In the illustrated embodiment of FIG. 5B, the door 100 includes a fastening track 503 having a pair of raised portions 502 extending along the top edge 108 and forming a recess 504 therebetween. The fastening track 503 can be formed from a variety of materials known in the art, e.g., extruded polyvinyl chloride (PVC). The raised portions 502 can include a plurality of T-slots 509 for attaching one or more components. Although not visible in FIG. 5, the side edges of the door 100 can similarly include a fastening track 503 having T-slots for attaching components. For example, the side seals 118 can be attached to the door 100 via T-slots along the side edges. The fastening track 503 along the top edge and a corresponding fastening track along the side edge can be attached to the door via an angle fastener 507 and one or more additional fasteners 508 (e.g., screws).

Figure 6:
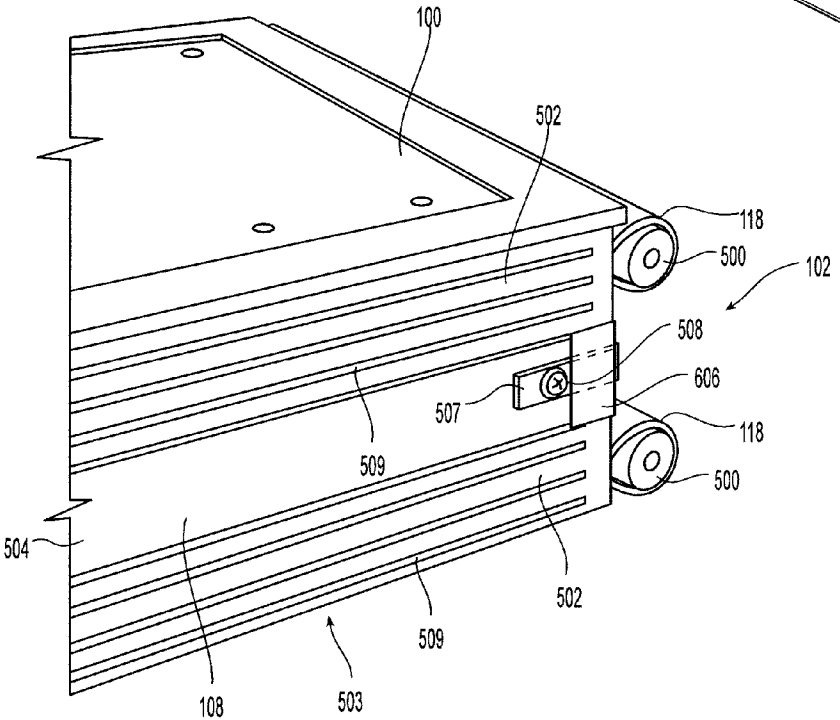
FIG. 6 is an isometric top view of a door sealing system configured in accordance with an embodiment of the present technology.

FIG. 6 is an isometric top view of the door 100 and the door sealing system 102 configured in accordance with an embodiment of the present technology. In the illustrated embodiment, a piece of compressible and resilient weather strip 606 is attached to the door 100 in the recess 504 via, e.g., an adhesive. The weather strip 606 can form a seal between the door and an attached seal extension 106 or 400 and prevent air from entering the recess 504 via a gap between the seal extension 106 or 400 and the door 100.

Figure 7:
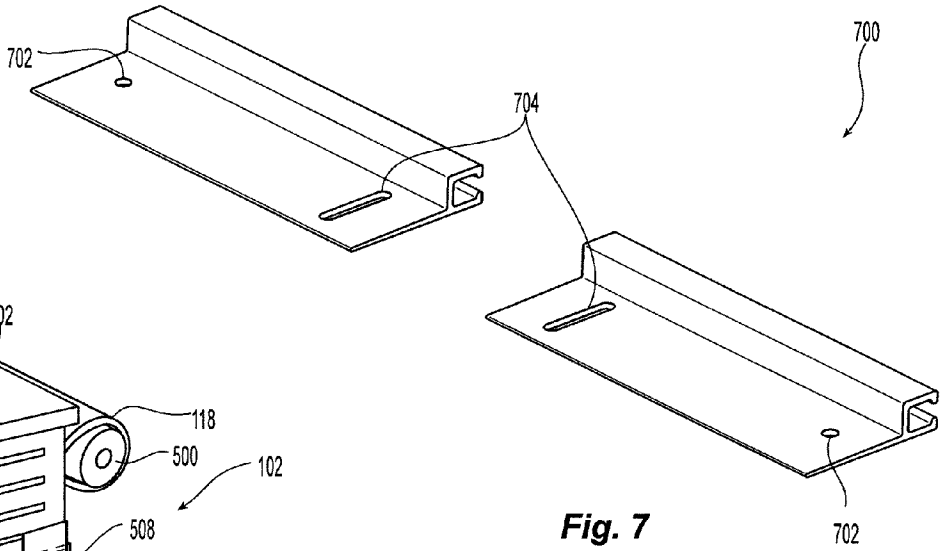
FIG. 7 is an isometric top view of a seal retainer configured in accordance with an embodiment of the present technology.

FIG. 7 is an isometric top view of a seal retainer 700 configured in accordance with an embodiment of the present technology. The seal retainer 700 can be at least generally similar in structure and function to the seal retainer 110 described above in reference to FIGS. 1A and 1B and can mount a blade seal to a door edge and retain the blade seal against an adjacent wall or other structure or component. In the illustrated embodiment, the seal retainer 700 includes openings 702 (e.g., circular openings) positioned near the ends of the seal retainer 700 and slotted openings 704 positioned along the length of the seal retainer 700. Fasteners (e.g., screws) can be inserted through the openings 702 and 704 to secure the seal retainer 700 to a door (e.g., to an upper or top edge of the door, as shown in FIG. 1A). The slotted openings 704 can provide for inward and outward flexing of the door, and can assist in maintaining a seal against an adjacent wall during such flexing. For example, very high temperatures, or large temperature differences between an interior and exterior of a facility, can result in bowing or warping of a door. The seal retainer 700 can remain in position while the door flexes, with the fasteners that extend through the slotted openings 704 allowing the middle portion of the door to bow inward or outward by moving relative to the slotted openings 704. The fasteners in the slotted openings 704 can incorporate, e.g., fender washers and may be tightened to reduced torque to facilitate this door flexing. Accordingly, the seal retainer 700 can maintain an associated blade seal in position against a wall while a door bows or flexes.

Figure 8:
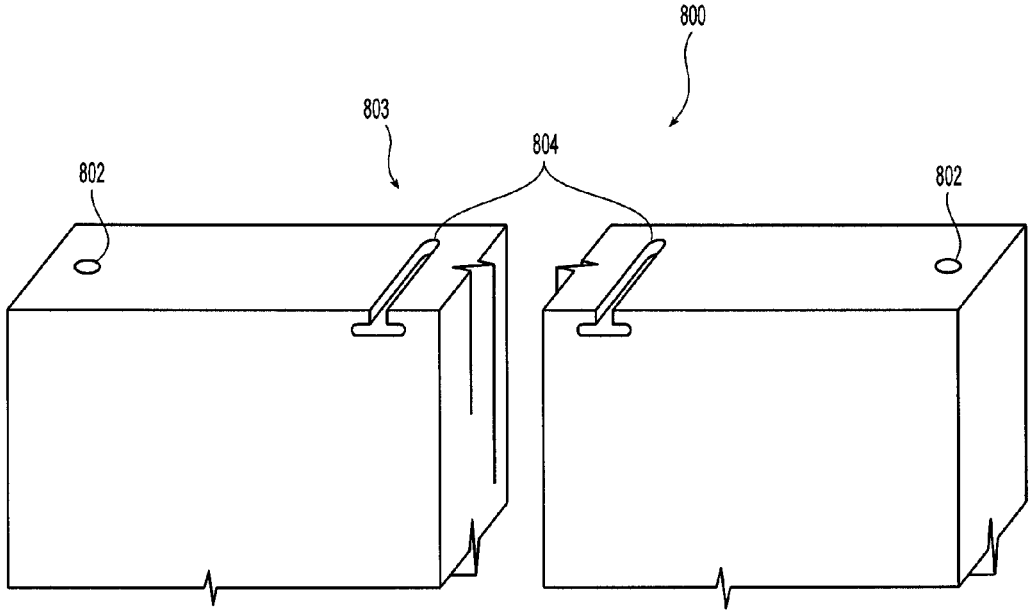
FIG. 8 is an isometric top view of a door configured in accordance with an embodiment of the present technology.

FIG. 8 is an isometric top view of a door 800 configured in accordance with an embodiment of the present technology. The door 800 includes a retainer mounting system 803 having circular openings 802 and T-shaped slotted openings 804 that enable flexing of the door while maintaining a seal against an adjacent wall. For example, a seal retainer can be attached to the door 800 via fasteners positioned in the circular openings 802. Guide pins or other components can extend through or from the seal retainer into the slotted openings 804. The guide pins can be shaped to match and engage with the T-shaped slotted openings 804. The middle portion of the door 800 can thereby flex inward or outward while the guide pins move within the slotted openings and the attached seal retainer maintains the position of an associated blade seal against an adjacent wall. Although the door 800 in the illustrated embodiment includes T-shaped slotted openings 804, doors configured in accordance with the present technology can include slots, openings, or other components of a variety of shapes that can engage a retainer or a component attached thereto. For example, in some embodiments, the openings may be slots that do not include a "T" portion.

Figure 9:
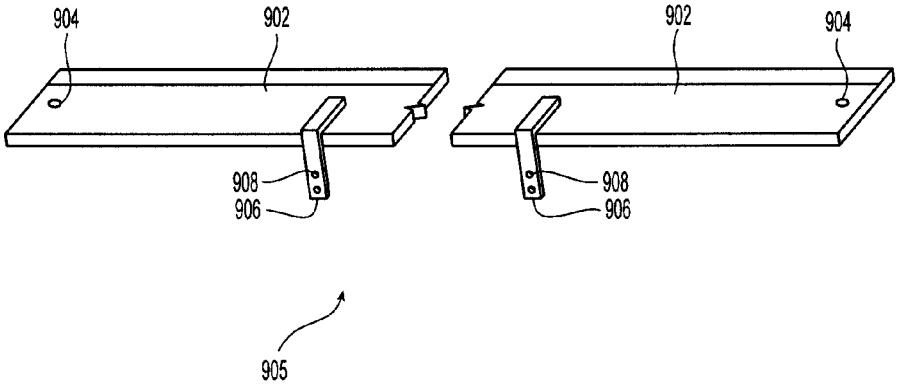
FIG. 9 is an isometric top view of a seal retainer having a mounting system configured in accordance with an embodiment of the present technology.

FIG. 9 is an isometric top view of a seal retainer 902 having a mounting system 905 configured in accordance with an embodiment of the present technology. In the illustrated embodiment, the seal retainer 902 includes circular openings 904 positioned at the far ends for attaching the ends of the seal retainer 902 to a door. The mounting system 905 includes at least one mounting bracket 906 having openings 908. The mounting brackets 906 can be attached to a backside of a door via fasteners extending through the openings 908. The mounting brackets 906 can extend up the back of the door and across a top edge of the door to engage the seal retainer 902. In operation, as a door flexes inward or outward, the mounting brackets 906 can slide inward or outward while maintaining contact with the seal retainer 902. The mounting brackets can thereby urge the seal retainer against the top edge and keep the seal retainer 902 in position as the door flexes.

From the foregoing, it will be appreciated that specific embodiments have been described herein for purposes of illustration, but that a variety of modifications may be made without deviating from the spirit and scope of the various embodiments of the disclosure. For example, although certain embodiments of the present technology include seal extensions that are secured to a door via an adjustable mounting feature that includes screws, other adjustable mounting features can include a variety of suitable components to provide a similar effect. In some embodiments, a seal extension can be slidably coupled to a track and locked into position via one or more fasteners. Furthermore, it is within the scope of the present disclosure to provide other types of components for providing enhanced sealing of doors. For example, in place of or in addition to a bulb seal portion, a seal extension can include foam or another compressible material that can be positioned to form a seal between a door and an adjacent track assembly.

Further, while various advantages and features associated with certain embodiments of the present technology have been described above in the context of those embodiments, other embodiments may also exhibit such advantages and/or features, and not all embodiments need necessarily exhibit such advantages and/or features to fall within the scope of the disclosure. Accordingly, the disclosure is not limited, except as by the appended claims.

We claim:

1. A sealing system comprising:
an overhead door having a top edge;
a blade seal positionable along the top edge to form a first seal portion between the door and an adjacent surface;
a seal retainer for securing the blade seal to the door; and
a seal extension positionable to at least partially overlap the blade seal and form a second seal portion between the door and the adjacent surface, wherein
the seal extension includes—
a body having a first edge, a second edge, and at least one adjustable mounting feature;
a bulb seal portion extending from the first edge and positionable to form a seal with a track assembly; and
a blade seal portion extending from the second edge and positionable to form the second seal portion.

2. The sealing system of claim 1 wherein the seal retainer includes at least one slotted opening positioned to receive a fastener to movably secure the blade seal to the door.

3. The sealing system of claim 1, further comprising:
a side seal positionable along a side edge of the door, the side seal including an internal cavity; and
a bulb plug positionable at least partially within the internal cavity of the side seal to form a seal between the seal extension and the side seal.

4. The sealing system of claim 1, further comprising a weather strip positionable within a recess along the top edge to form a seal between the door and the seal extension.

5. The sealing system of claim 1 wherein the blade seal portion includes a slot for receiving a cable.

6. The sealing system of claim 1 wherein
the bulb seal portion comprises a folded fabric attached to the body via stitching.

7. A method for forming a seal between a door and a facility, the method comprising:
attaching or instructing the attachment of a seal extension to a top edge of the door adjacent to a blade seal, wherein—
the blade seal is positioned to form a first seal portion between the door and an adjacent surface, and
the blade seal is secured to the door via a seal retainer; and
adjusting or instructing adjustment of the seal extension to at least partially overlap the blade seal and form a second seal portion between the door and the adjacent surface, wherein—
the seal extension includes—
a body having a first edge, a second edge, and at least one adjustable mounting feature;
a bulb seal portion extending from the first edge and positionable to form a seal with a track assembly; and
a blade seal portion extending from the second edge and positionable to form the second seal portion.

8. The method of claim 7, further comprising positioning or instructing positioning of a bulb plug within a side seal attached to the door.

9. The method of claim 7, further comprising attaching or instructing attachment of a weather strip in a recess on the top edge of the door.

10. The method of claim 7, further comprising positioning or instructing positioning of the seal extension to receive a cable within a cable slot.

* * * * *

UNITED STATES PATENT AND TRADEMARK OFFICE

CERTIFICATE OF CORRECTION

PATENT NO. : 9,212,510 B2
APPLICATION NO. : 13/924868
DATED : December 15, 2015
INVENTOR(S) : William C. Eungard et al.

It is certified that error appears in the above-identified patent and that said Letters Patent is hereby corrected as shown below:

IN THE CLAIMS

In column 10, line 16, in claim 7, after "attaching" delete "or instructing the attachment of".

In column 10, line 23, in claim 7, after "adjusting" delete "or instructing adjustment of".

In column 10, line 35-36, in claim 8, after "positioning" delete "or instructing positioning of".

In column 10, line 38-39, in claim 9, after "attaching" delete "or instructing attachment of".

In column 10, line 42, in claim 10, after "positioning" delete "or instructing positioning of".

Signed and Sealed this
Twelfth Day of April, 2016

Michelle K. Lee

Michelle K. Lee
*Director of the United States Patent and Trademark Office*